United States Patent [19]

Gilhula

[11] 3,938,268

[45] Feb. 17, 1976

[54] INDEX SYSTEM

[76] Inventor: Harry C. Gilhula, 2802 Robinson Road, SE., Grand Rapids, Mich. 49506

[22] Filed: Jan. 31, 1974

[21] Appl. No.: 438,296

[52] U.S. Cl. ..... 40/23 A; 283/36

[51] Int. Cl.[2] ..... G09F 3/16; B42F 21/00

[58] Field of Search ..... 283/36–43; 40/2, 23 A, 360; 206/820

[56] References Cited

UNITED STATES PATENTS

| | | | |
|---|---|---|---|
| 3,054,202 | 9/1962 | Scholfield | 40/23 A |
| 3,070,482 | 12/1962 | Cunningham | 40/23 A |
| 3,303,080 | 2/1967 | Aguilera | 283/36 X |
| 3,348,324 | 10/1967 | Cunningham | 40/23 A |
| 3,473,827 | 10/1969 | Leadbetter | 283/36 |
| 3,583,358 | 6/1971 | Hanson | 283/42 X |

*Primary Examiner*—Lawrence Charles
*Attorney, Agent, or Firm*—Price, Heneveld, Huizenga & Cooper

[57] ABSTRACT

An index system for indexing directories such as telephone books includes a paper guide strip positioned adjacent a film plastic tab strip segmented into a plurality of uniquely identified tabs spaced along the tab strip. The guide and tab strips are coupled to one another along adjacent edges by means of an adhesive transfer strip extending the length of the guide and tab strips along the junction thereof on one side. As tabs are removed for application, the pressure-sensitive adhesive is transferred to the tabs while the guide and transfer strips serve as a guide for positioning the tabs on the pages of the directory.

7 Claims, 3 Drawing Figures

INDEX SYSTEM

BACKGROUND OF THE INVENTION

The present invention relates to index systems and more particularly to an improved index tab structure for application of tabs to pages of a book.

Several indexing systems are available for application of index tabs to books such as telephone directories whereupon the tabs extend from the edge of the book to identify alphabetical or numerical subdivisions of these directories. One such system is represented by U.S. Pat. No. 3,303,080 issued to J. Aguilera on Feb. 7, 1967. This and several other systems employ a tab which requires folding of the tab during its application and a pressure-sensitive tape for coupling the tab to opposite sides of the page to which the tab is applied. Such construction is somewhat complex and, therefore, expensive as well as being cumbersome to employ when applying the tabs.

SUMMARY OF THE INVENTION

The index system of the present system, however, overcomes the relatively complex structure of the prior art and provides a tab system whereupon tabs are provided with a single pressure-sensitive adhesive contact surface and are manufactured in conjunction with a guide and adhesive transfer strip to facilitate the application of the tabs to the pages of a book. In addition, the improved structure is relatively uncomplicated thus reducing the cost of manufacture.

Index systems embodying the present invention include a tab strip segmented into a plurality of indexing tabs and guide and adhesive transfer means to which the tab strip is coupled. The guide and adhesive transfer means provides support for the tab strip and apply adhesive to tabs as they are removed for application. The guide and transfer means also provides a reference for accurately applying tabs along successive sections of a book.

It is an object of the present invention, therefore, to provide an improved index tab system.

It is a further object of the present invention to provide an indexing system whereupon a tab with a single pressure-sensitive adhesive surface is employed.

Another object of the present invention is to provide an index system for employing a tab strip and an adhesive transfer strip for transferring adhesive to the tab members as they are removed for application.

Still a further object of the present invention is to provide an indexing system employing a guide strip adjacent a tap strip which is removably coupled by means of an adhesive transfer strip.

These and other objects of the present invention will become apparent upon reading the following description thereof together with the accompanying drawings in which:

DETAILED DESCRIPTION OF THE PREFERRED EMBODIMENT

Figure 1:
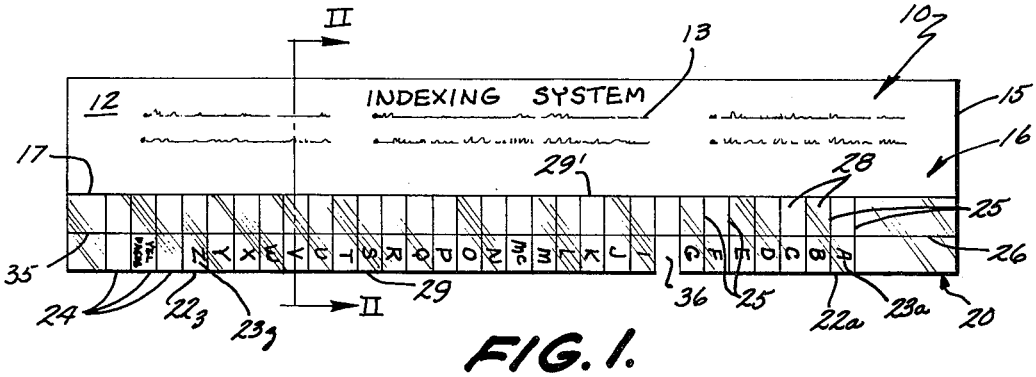
FIG. 1 is a top plan view of the index system embodying the present invention showing tab H removed therefrom.
Figure 2:
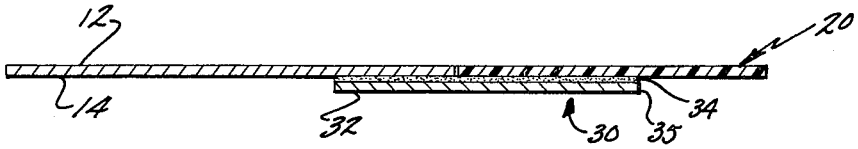
FIG. 2 is an enlarged cross-sectional view of the tab system shown in FIG. 1 taken along section lines II—II.

Referring now to FIGS. 1 and 2, there is shown the index system which comprises a paper guide strip 10 having an upper surface 12 and a lower surface 14. Printed on the upper surface are written instructions 13 for the application of the tabs associated with the system. Along the right edge 15 there is provided an index arrow 16 which identifies the reference edge for applying the tabs as described below.

Adjacent the bottom edge 17 (as seen in FIG. 1) of the guide strip 10, there is positioned an indexing tab strip 20 segmented into a plurality of discrete tabs 22*a*–22*z*, each of which includes printed indicia 23*a*–23*z* which, in the preferred embodiment, is the alphabet. Additional tabs 24 are provided for miscellaneous use such as identifying YELLOW PAGES, directory subheadings, indices, etc. In other embodiments, different alphabets or numerical tabs may be employed. The tabs are divided into a tab indicia portion 22 and an adhesive portion 28 of approximately the same size. Dividing line 26 indicates the boundary between these integral areas. In the preferred embodiment, the individual tabs were segmented by cutting lines 25 across the width of the strip between each of the tabs to define its boundaries.

The tab strip and tabs thereon are removably coupled to the guide strip by means of an adhesive transfer strip 30 comprising a wax impregnated base strip 32 to which there is applied a pressure-sensitive adhesive 34 which adheres to base 32 only slightly and will transfer to the tabs when the tabs are removed. The transfer tape is coupled to the junction of the guide strip and the tab strip to extend along and have an edge 35 parallel to and in spaced relationship from edge 29 of the tab strip and overhang the tab strip for attachment of the guide strip as best seen in FIG. 2. Several materials can be employed for the tab strip as well as the transfer tape. In the preferred embodiment, a .005 inch thick film of transparent plastic material was employed. The plastic can be ABS, acrylic acetate or other film plastic which is relatively rigid and will accommodate printing of the index indicia thereon. The preferred plastic film employed in the embodiment shown was MYLAR, manufactured and sold by E. I. DuPont de Nemours Corporation. The adhesive transfer tape employed in the preferred embodiment was DUBL-STIK tape available from Kleen-Stik Products of Newark, New Jersey. There are several other commercially available adhesive transfer tapes, however, which would likewise suffice.

The length of the guide strip, the tab strip, and the transfer tape was approximately 11 inches to accommodate a standard directory. The width of the paper guide strip was 1.5 inches while the tab strip was .875 inch in width divided into a .375 inch zone for the tab indicia and a 0.5 inch zone for the transferred adhesive. The indicia was printed on the upper surface of the tabs (as seen in FIG. 2) in the preferred embodiment. The width of transfer tape 30 was .750 inch and was applied to the junction of the edges 17 and 29' of guide strip 10 and tab strip 20, respectively, with 0.5 inch underlaying the tap strip.

The index tab construction shown in FIGS. 1 and 2 is best manufactured by employing a continuous tape for each of the guide, tab and adhesive transfer strips with periodic printing of the instructions at spaced intervals on the guide tape and of the tab indicia on the tab tape. The three tapes are simultaneously fed through pressure rollers for coupling the guide tape to the tab tape by means of the transfer tape with the guide arrow 16 of each guide strip in alignment with the top edge of an associated tab strip. The continuous composite structure thereformed is then fed through cutters which periodically cut the strips into the 11 inch segments shown in FIG. 1. Tabs 22 and 24 are then formed by cutting along lines 25. The resultant indexing system with self-contained instructions, pricing, etc., can then be packaged in a transparent polyethylene container for shipment and sale.

Figure 3:
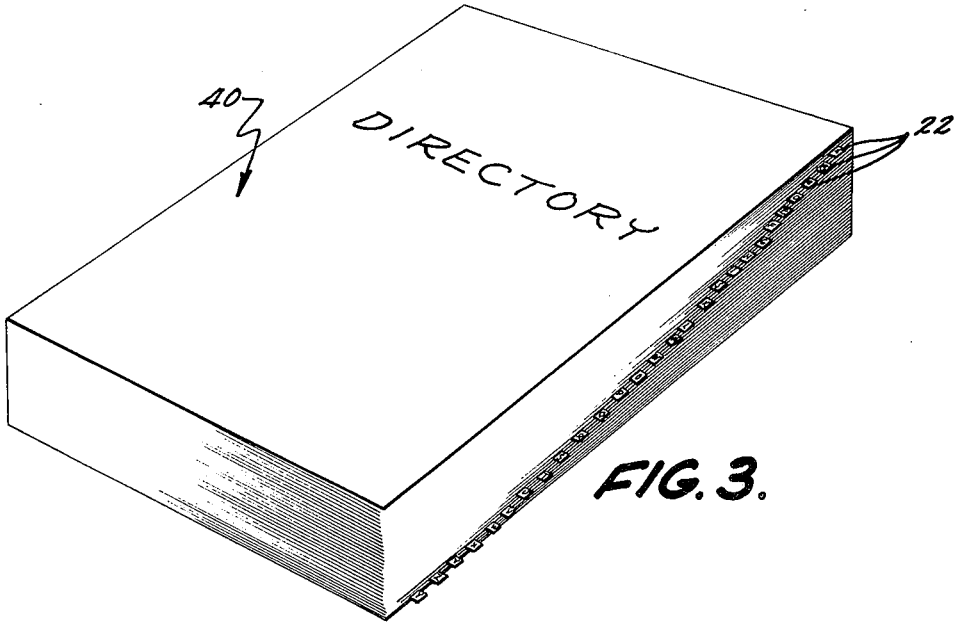
FIG. 3 is a perspective view of a directory to which the tabs of the present invention have been applied.

For installation of the tabs to a directory 40, as shown in FIG. 3, the user merely opens the directory to the first page of the section to be tabbed and aligns the reference edge 15, identified by arrow 16, to the top of the page and the edge 29 (as seen in FIG. 1) of the tab strip with the free edge of the page. If the tabs have not been precut, they must be separated by cutting along lines 25. With the composite tab and guide means in alignment on the page, the tab for that page is peeled off of the transfer tape by gripping the indicia portion of the tab and pulling the tab from the transfer tape. The free tab is then applied to the page by aligning the rear edge 29' of the tab adjacent the now uncovered edge 35 of the transfer tape 30 with the transferred adhesive on the tab facing the page. Pressure is applied to the adhesive segment of the tab once it is in the aligned position to complete its application.

As seen in FIG. 1, when a tab has been removed and prior to its attachment, a void area 36 will exist where the tab was previously attached to the strip. The next adjacent remaining tab or tabs still on the strip will thus provide a horizontal reference line(s) for applying the removed tab. Normally, the tabs will be applied in the sequence A–Z such that the next tab of the alphabet will provide a reference edge for the lower edge of the tab to be applied. The assembly is removed and similarly positioned in alignment on the next page of the directory to which the subsequent tab is to be applied and the application step repeated until the directory is tabbed as seen in FIG. 3.

It has been found that the pressure-sensitive adhesive in combination with the tab structure provides excellent durability and adhesion of the tab to the edge of the directory without requiring application of the tabs to both sides of the page by folding a tab of more complex construction. The .005 inch thickness MYLAR employed was sufficiently rigid and the adhesion sufficient to permit opening of the directory to the desired page by employing the tab as a handle.

It will become apparent to those skilled in the art that various modifications to the preferred embodiment can be made. For example, for some applications guide strip 10 could be removed and the pressure-sensitive adhesive applied directly to the adhesive surface of the tabs and covered by a wax impregnated strip which could serve as a guide strip. Thus, the guide and adhesive means could be combined. In some embodiments, the tabs can be segmented only by printing boundary lines between adjacent tabs. In such embodiments, the purchaser of the index system separates the individual tabs by cutting along lines 25 prior to application of the tabs. These and other modifications of the present invention, however, will fall within the spirit and scope of the present invention as defined by the appended claims.

The embodiments of the invention in which an exclusive property or privilege is claimed are defined as follows:

1. An index tab assembly comprising:

a tab strip, initially free of adhesive, defining a plurality of tabs;

an adhesive transfer strip comprising a base strip made of a material from which adhesive is readily removeable and an adhesive film initially adhered to said base strip, said adhesive transfer strip being adhered to and extending from said tab strip spaced from an edge thereof for transferring a pressure-sensitive adhesive from said adhesive transfer strip to a portion of each tab of said tab strip as the tabs are removed from said adhesive transfer strip.

2. The index tab assembly as defined in claim 1 wherein guide means are associated with said tab strip for permitting alignment of tabs of said tab strip with respect to a page of a directory, said guide means including a guide strip adhered to said adhesive transfer strip and including a reference edge adapted to be aligned with an edge of a directory page for applying a tab at a predetermined location on said directory page.

3. The index tab assembly as defined in claim 2 wherein said adhesive transfer strip includes a portion overhanging said tab strip and wherein said guide strip is adhered to said overhanging portion of said adhesive transfer strip adjacent said tab strip.

4. An index tab assembly comprising:

a tab strip, initially free of adhesive, defining a plurality of tabs with indicia printed directly on a surface of said tabs;

an adhesive transfer strip comprising a base strip made of a material from which adhesive is readily removeable and an adhesive film initially adhered to said base strip, said adhesive transfer strip being adhered to a surface of said tab strip and extending along said tab strip spaced from an edge thereof for transferring a pressure-sensitive adhesive from said adhesive transfer strip to a portion of each tab of said tab strip as tabs are removed from said adhesive transfer strip;

said adhesive transfer strip being sufficiently wide that it overhangs said tab strip; and guide means adhered to said overhanging portion of said adhesive transfer strip by the adhesive thereon for permitting alignment of said tab strip with respect to a page of a directory.

5. The index tab assembly as defined in claim 4 wherein said guide means comprises a guide strip including a reference edge, said guide strip coupled to said overhanging portion of said adhesive transfer strip adjacent said tab strip such that said reference edge is positioned to be aligned with an edge of a directory page to align tabs in predetermined orientation with respect to said directory page.

6. The index tab assembly as defined in claim 5 wherein said tab strip is made of film plastic and said adhesive transfer strip base is wax impregnated paper and said adhesive film is a pressure-sensitive adhesive coating said base.

7. The index tab assembly as defined in claim 5 wherein said tab strip is made of film plastic and said tabs are segmented by printed lines on said tab strip defining the boundaries of said tabs.

* * * * *